US006618572B2

(12) United States Patent
Morganti et al.

(10) Patent No.: US 6,618,572 B2
(45) Date of Patent: Sep. 9, 2003

(54) MECHANISM FOR REMOVING SLACK IN THE WEB OF CLEANING MATERIAL IN AN ELECTROPHOTOGRAPHIC MACHINE

(75) Inventors: Terry N. Morganti, Brockport, NY (US); James V. Orchard, II, Holley, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/144,581

(22) Filed: May 13, 2002

(65) Prior Publication Data

US 2003/0016972 A1 Jan. 23, 2003

Related U.S. Application Data

(60) Provisional application No. 60/307,217, filed on Jul. 20, 2001.

(51) Int. Cl.[7] ..... G03G 15/20
(52) U.S. Cl. ..... 399/327
(58) Field of Search ..... 399/327, 325, 399/320, 326, 324, 123, 71, 34, 328, 330, 352; 219/216; 192/46; 242/538.1, 538.2, 545, 546.1; 15/100, 256.51

(56) References Cited

U.S. PATENT DOCUMENTS 4,110,035 A * 8/1978 Kamata ..... 399/352
5,930,574 A * 7/1999 Segawa ..... 399/327
6,253,413 B1 * 7/2001 Onuma et al. ..... 399/352
6,278,860 B1 * 8/2001 Morganti et al. ..... 399/327
6,292,646 B1 * 9/2001 Maul et al. ..... 399/325
6,305,636 B1 * 10/2001 Satoh et al. ..... 399/327

FOREIGN PATENT DOCUMENTS

JP 07287466 * 10/1995 ..... G03G/15/20
JP 08095417 * 3/1996 ..... G03G/15/20
JP 08185074 * 7/1996 ..... G03G/15/20

* cited by examiner

*Primary Examiner*—Susan S. Y. Lee
*Assistant Examiner*—Ryan Gleitz

(57) ABSTRACT

An apparatus and method for taking up the slack in the web material between the supply roller and the take-up roller in the web cleaning assembly of an electrophotographic apparatus. A clutch mechanism is positioned between the drive gear on the take-up roller and the hub of the motor that drives the drive gear. A spring-biased pawl on the hub engages a tooth of an inner gear on the drive gear to provide a driving connection between the hub and the take-up gear when the motor drives the hub in a first direction but effectively releases the driving connection when the take-up gear is manually rotated while the motor is idle. This allows the take-up roller to be rotated to take up the slack in the web without having to rotate the motor.

15 Claims, 4 Drawing Sheets

MECHANISM FOR REMOVING SLACK IN THE WEB OF CLEANING MATERIAL IN AN ELECTROPHOTOGRAPHIC MACHINE

RELATED APPLICATIONS

This application is entitled to and hereby claims the benefit of U.S. provisional application No. 60/307,217 filed Jul. 20, 2001.

FIELD OF THE INVENTION

The present invention relates to a mechanism for taking up the slack in a web of cleaning material when changing supply and take-up rollers in a fuser section of an electrophotographic copier/printer machine and in one of its aspects relates to a clutch mechanism which allows the take-up roller of a web cleaning assembly to be advanced without actuation of the drive motor whereby any slack in the web between the supply roller and the take-up roller can be removed manually before the machine is put into operation.

BACKGROUND OF THE INVENTION

In a typical electrophotographic machine (e.g. copier, duplicator, printer, etc.), a continuous loop of photoconductor film is commonly used to transfer an image from an input section onto a receiving medium (e.g. a sheet of paper or the like). The film is charged and passed through an input section where an image (i.e. analog or digital) is projected onto the charged film. The film then moves through a developing section where toner is applied to the charged image before the image is transferred to the sheet of paper. The paper is subsequently passed through a fuser section where the toner is fixed to the paper by passing the paper between two rollers, i.e. a pressure roller and a fuser roller, one of which is heated. For example, it is common to heat the fuser roller by positioning the fuser roller in contact with one or more heater rollers, which in turn, transfer heat to the fuser roller.

A known problem in fuser sections of this type is that known as "offset" which occurs when some of the heat-softened toner particles remain on the fuser roller and are not transferred to the paper as desired. As well understood in the art, this offset can severely affect the quality of the copies being made by the machine. To alleviate this problem, a release oil is typically applied onto the fuser roller to prevent the toner from sticking thereto.

Due to the direct contact between the fuser roller and the heater rollers, the heater rollers also effectively act as cleaning rollers in that they pick up excess release oil along with other contaminants, e.g. residual toner, paper dust, etc., from the fuser roller. In turn, these contaminants must be continuously removed from the heater rollers during the copying operation in order to maintain high quality copies from the machine. Accordingly, most machines of this type now include some means for continuously "cleaning" these contaminants off of the heater rollers during the copying operation.

One known way to clean the heater rollers is to provide a "web cleaning" assembly within the fuser section which includes a length or "web" of cleaning material (i.e. woven material such as NOMEX). The web is wound onto a supply roller which is removably positioned within the assembly and continuously contacts and "wipes" the contaminants off of the heater rollers as the web is pulled onto a take-up roller which, in turn, is rotated through a set of gears by a drive motor. Since the web material is regularly advanced during the copying operation, the web material on the supply roller will eventually run out and will need to be replaced. That is, both the empty supply roller and the full take-up roller will need to be replaced whenever the supply of web material runs out.

Since these rollers will need to be replaced on a relatively frequent basis, the procedure for changing out the rollers should be as easy and as mistake proof as possible. Preferably, this should be simple enough so that an operator of the machine, vis-a-vis a dedicated service technician, can be given minimal training to perform this task as needed thereby averting a service call each time the web material runs out.

In known machines of this type, the supply and take-up rollers are normally replaced by pulling the web cleaning assembly out from the fuser housing on a slide rail mounted therein. A spring-loaded pin is released at one end of the take-up roller that is then lifted off a pin at the other end. Once one roller (e.g. full take-up roller) is free, the other roller (e.g. empty supply roller) is removed in a similar manner and the respective rollers are replaced by reversing this procedure.

Whenever the supply and take-up rollers are replaced, a certain amount of "slack" will remain in the web after the web has been properly "threaded" through its operational path in the cleaning assembly (i.e. from the supply roller, around a tensioning roller and into contact with the heater rollers, and onto the take-up roller). As will be understood in this art, removing this slack after the rollers have been installed is normally difficult to accomplish. If this slack is not removed before the machine is put back into operation, the slackened web can be drawn into the heater rollers which, in turn, is likely to tear the web off of one or the other of the rollers thereby resulting in substantial downtime and expense.

In known machines of this type, this slack is removed from the web by manually rotating the take-up roller to thereby wind up the excess web onto the take-up roller. However, this procedure requires that the drive shaft of the drive motor be manually rotated along with the associated meshed gears which drive the take-up roller. Since the commercially available drive motors commonly used in these machines normally have high gear ratios (i.e. 180 to 1), the manual turning of the motor is extremely difficult to accomplish with the tools normally available to a technician. Accordingly, those skilled in this art will readily recognize the benefits of simplifying the exchange of web supply and take-up rollers in a web cleaning assembly of an electrophotographic machine wherein the slack normally present in the web after such an exchange can easily and quickly be removed by a technician without the need of special tools or assistance.

SUMMARY OF THE INVENTION

The present invention provides an electrophotographic apparatus having a fuser section which includes a web cleaning assembly and a method for servicing the web cleaning assembly to take-up the slack in the web cleaning material when the supply and take-up rollers are replaced therein. Basically, a clutch mechanism is positioned between the drive gear on the take-up roller and the hub on the drive shaft of the motor which drives the drive gear. A spring-biased pawl on the hub cooperates with an inner set of teeth on the drive gear to provide a driving connection between the hub and the take-up gear when the motor drives the hub in a first direction but effectively releases the driving connection when the take-up gear is manually rotated while the motor is idle. This allows the take-up roller to be rotated to take up the slack in the web without having to rotate the drive shaft of the motor.

More specifically, the present invention relates to a web cleaning assembly which is adapted to be mounted in the fuser section of an electrophotographic apparatus for cleaning contaminates off of at least one heater roller in the fuser section. The web cleaning assembly includes a frame having a supply roller on which a web of cleaning material is wound and a take-up roller that receives the used cleaning material after the material has contacted and removed contaminants from the heater roller(s) in the fuser section of the apparatus.

A drive gear is drivingly connected to the take-up roller and has a set of outer teeth around its circumference and a set of inner teeth around a central bore therethrough. The central bore is positioned onto a hub, which in turn, is drivingly connected onto the drive shaft of a motor. The hub has a slot in which a pawl is pivotably mounted, the outer end of which is biased outwardly by a spring or the like. The outer end of the pawl engages one of the inner teeth to form a driving connection between the hub and the drive gear wherever the motor drives the hub in a first direction.

A handle extends across the outside of the drive gear and is secured thereto by bolts or the like by which the drive gear can be manually rotated while the motor is idle and the hub is stationary. Since the outer teeth on the drive gear are meshed with the teeth on the take-up gear, the take-up roller can be rotated and any slack in the web material can be taken-up by merely turning the handle on the drive gear without having to turn the drive shaft of the motor. This highly simplifies the removal and installation of the supply and take-up rollers in the web cleaning assembly since the high gear ratio (e.g. 180 to 1) normally found in motors of this type makes the manual turning of motor and associated gears difficult.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents that may be included within the spirit and scope of the invention, as defined by the appended claims.

DESCRIPTION OF THE PREFERRED EMBODIMENTS

Figure 1:
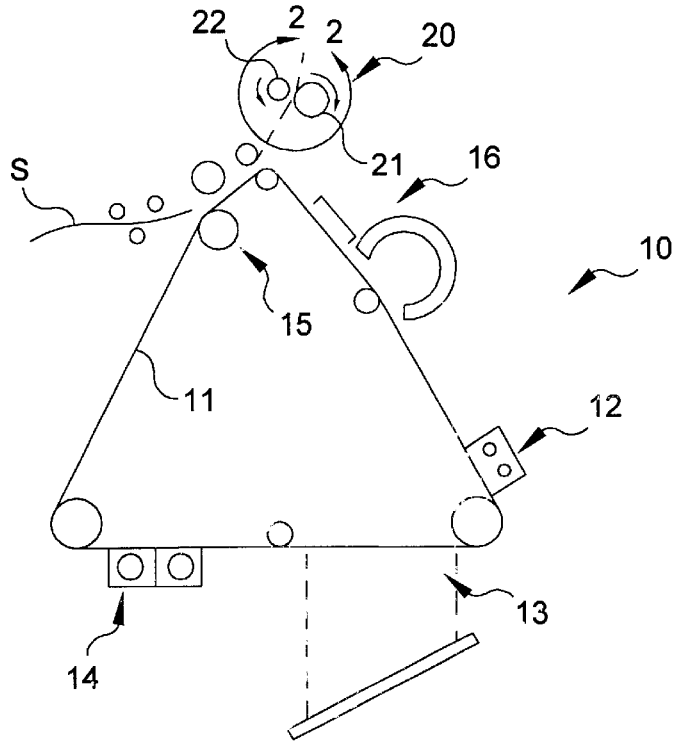
FIG. 1 (PRIOR ART)
FIG. 1 is a schematic view of an electrophotographic apparatus (e.g. copier/printer machine) in which the present invention can be incorporated.

Referring briefly to FIG. 1, illustrated is a typical electrophotographic apparatus or machine 10 (e.g. copier, duplicator, printer) of the kind that has an endless photoconductor member 11 (e.g. photographic film) which moves through a closed loop past a charging station 12, an exposure or input station 13, a developing station 14, a transfer station 15, and an erase section 16. A copy medium (e.g. a sheet S of paper) is fed from a supply (not shown) through transfer station 15 where the toner image on the film 11 is transferred onto the paper S. The paper S is then fed between a heated, fuser roller 21 and a pressure roller 22 in fuser section 20 to fix the toner image on the paper S.

Figure 2:
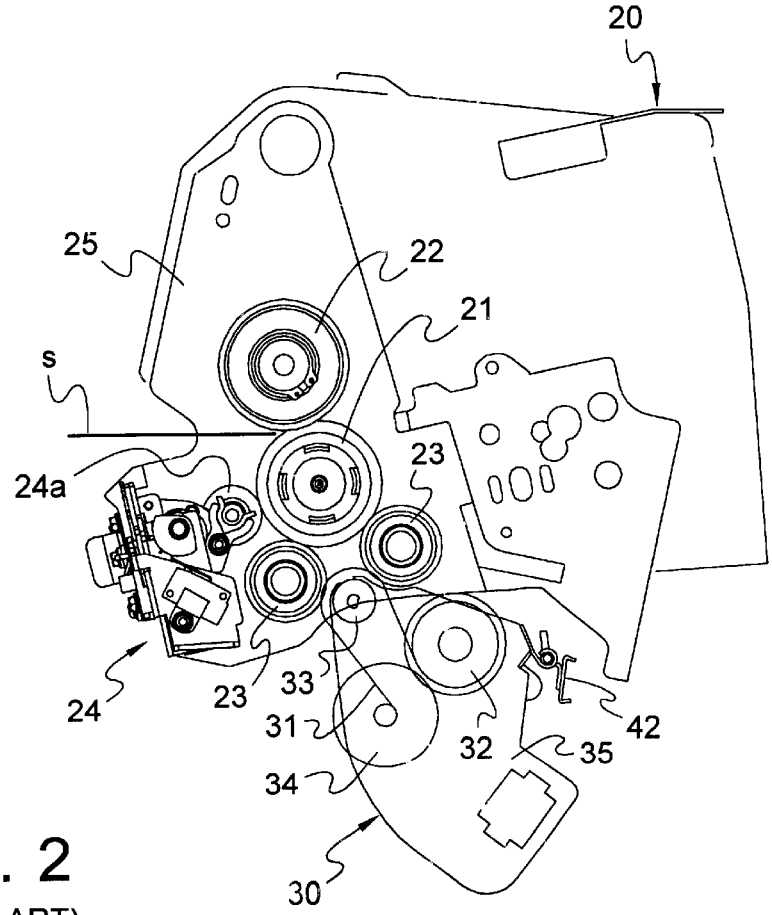
FIG. 2 (PRIOR ART)
FIG. 2 is an end view of a fuser section such as that lying within line 2—2 of FIG. 1 having the web cleaning assembly of the present invention incorporated thereon.

FIG. 2 is a end perspective view of a typical fuser section 20 which might be found in the electrophotographic machine 10 of FIG. 1. As illustrated, fuser section 20 is comprised of a frame or housing 25 in which pressure roller 22, fuser roller 21, and two heating rollers 23 are rotatably mounted. As will be understood in the art, a motor (not shown) mounted on the housing 25 rotates pressure roller 22, which in turn, rotates fuser roller 21 through the frictional contact therebetween. Fuser roller 21 is heated by heating rollers 23 so that when the sheet of paper S or the like passes through the nip between rollers 21, 22, the heat and pressure exerted thereby will cause the toner carried on S to become fused on the paper.

However, in fusers of this type, some of the toner particles are likely to adhere to fuser roller (i.e. "toner offset") which can severely affect the quality of the copies being made. To alleviate this problem, a wick roller assembly 24 is positioned within housing 25 and includes a wick roller 24*a* for applying a "release" oil directly onto fuser roller 21. This oil helps to prevent "offset", i.e. prevents toner from sticking to the fuser roller. Unfortunately, excess oil along with residual toner, paper dust, etc., may build-up on the fuser roller and be transferred to and contaminate heater rollers 23. If these contaminants are not removed from the heater rollers, they quickly affect the quality of the copies being made by the machine.

To remove these contaminants, a web cleaning assembly 30 is provided within fuser housing 25 which includes a web 31 of material which contacts the heater rollers 23 to "wipe" and remove the contaminants therefrom as the copying operation is being carried out. As is known in the art, web 31 may be comprised of any flexible, cleaning material which is capable of removing the contaminants from the heater rollers upon contact (e.g. woven cloth-like material such as NOMEX●) without damaging the heater rollers. The cleaning material 31 is wound onto supply roller 32 and passes over tensioner roller 33 and onto take-up roller 34. Tensioner roller 33 holds material in contact with both of heater rollers 23 when assembly 30 is in its operable position (FIGS. 2 and 4) within fuser housing 25.

Figure 3:
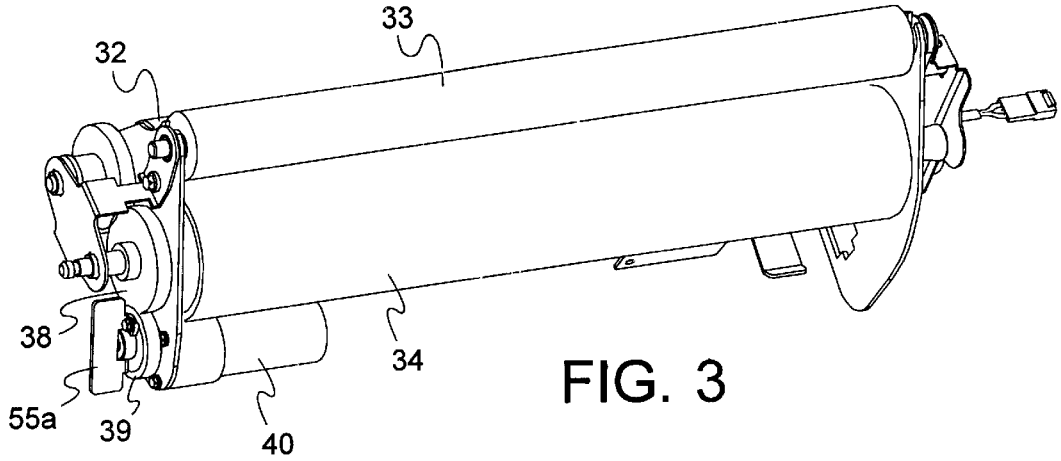
FIG. 3 is a perspective view of the web cleaning assembly of FIG. 2 when removed from the fuser section.

Since the cleaning material of web 31 is continuously advanced during the copying operation, the web of cleaning material will eventually run out and will have to be replaced on a routine basis. To facilitate this, web cleaning assembly 30 is comprised of a frame 35 which can be slid out of and into fuser section 20 on a telescoping slide 42 which, in turn, is mounted in the fuser housing 25. Supply roller 32 and take-up roller 34 are releasably secured for rotation within frame 35. Preferably, a first end of each roller (i.e. the end of the axle, not shown, of each roller) slidably fits into a respective first journal box which, in turn, is mounted in frame 35. The first journal box for the take-up roller 34 has a gear 38 secured to its outer end which, in turn, is driven by a gear 39 on motor 40 (FIG. 3) as will be explained in more detail below.

The other or second end of each roller axis is slidably positioned within a respective, second journal box (not shown), which in turn, is slidably or retractably mounted in the frame 35. When changing rollers, the second journal boxes are moved to a retracted position to release the a respective roller for removal. This procedure is reversed when installing a new respective roller. For additional details of such a web cleaning assembly, see co-pending and commonly assigned U.S. patent application Ser. No. 09/775,171, filed Feb. 1, 2001.

When the supply of web material 31 on supply roller 32 has been exhausted, assembly 30 is pulled forward until it clears fuser housing 25. Both the empty supply roller and the now-full take-up roller are removed and replaced with a full supply roller 32 and an empty take-up roller 34. Unfortunately, when the rollers are exchanged, a certain amount of slack (e.g. 31*s* in FIG. 4) normally occurs in the web material 31 as it is threaded along its operation path through housing 35 between supply roller 32, over tensioner roller 33, and onto take-up roller 34. If this slack is not removed before the machine is started, the web 31 can be pulled into the heater rollers 23 and be torn off of either the supply or take-up roller. As will be readily recognized by those skilled in this art, this can lead to considerable downtime and expense before copying can be resumed.

Previously, in known machines of this type, after the rollers have been exchanged, a small sheet metal handle (not shown) is used to rotate the drive gear on the drive motor 40 in a counterclockwise direction (FIG. 4) to remove the slack 31*s* from web 31. However, since a typical drive motor has a very high gear ratio (e.g. 180 to 1), it is difficult for the technician to manually turn the drive gear while it is in engagement with the motor.

In accordance with the present invention, a mechanism is provided in the web cleaning assembly 30 that allows a technician to easily take-up the unwanted slack from the web 31 after the supply and take-up rollers have been exchanged in housing 35. Basically, the present invention is comprised of a clutch mechanism 45, which cooperates between the drive shaft 41 of drive motor 40 and drive gear 39 for take-up roller 34 which allows the drive gear 39 to rotate relative to the drive motor even when the gears are otherwise engaged.

Figure 6:
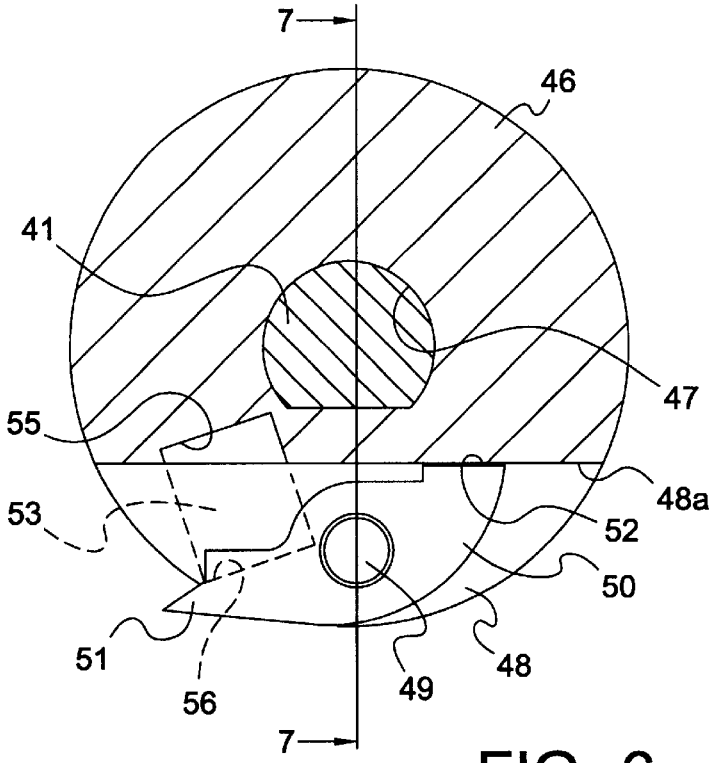
FIG. 6 is an enlarged, cross-sectional view of the hub for the drive motor of clutch mechanism of FIG. 5.
Figure 7:
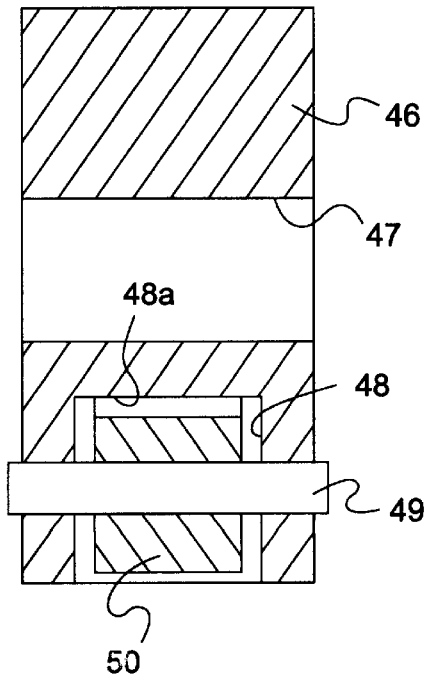
FIG. 7 is a sectional view of the hub for the drive motor taken along lines 7—7 of FIG. 6.

More specifically, clutch mechanism 45 is comprised of a hub 46 (FIGS. 6 and 7) which has a central D-shaped opening 47 which, in turn, is adapted to be positioned on the drive shaft 41 of drive motor 40. Hub 46 has a slot 48 provided therethrough, the outer surface of which is open along a portion of the circumference of the hub. Pawl 50 is pivotably mounted in slot 48 by pin 49 or the like. A compression spring 53 or the like biases the outer or forward end 51 of pawl 50 outwardly from hub 46 while the inner or rearward end 52 of pawl 50 abuts the inner surface 48*a* of slot 48 to limit rotation of the pawl within the slot. Spring 53 is preferably held in place within and between recesses 55 and 56 in hub 46 and pawl 50, respectively. When the pawl 50 is properly secured in slot 48, its forward end 51 will protrude from the slot to a point outside the circumference of hub 46 for a purpose described below.

Figure 4:
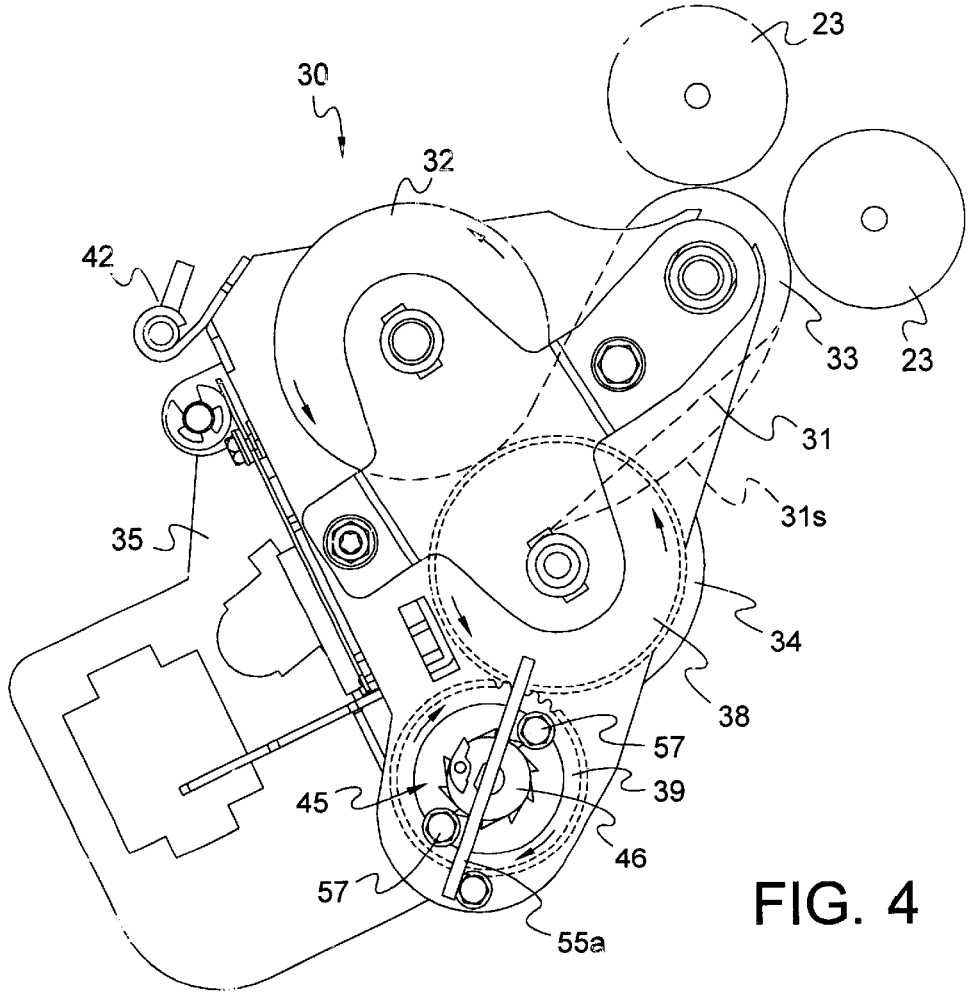
FIG. 4 is an end view of the web cleaning assembly of FIG. 3.
Figure 5:
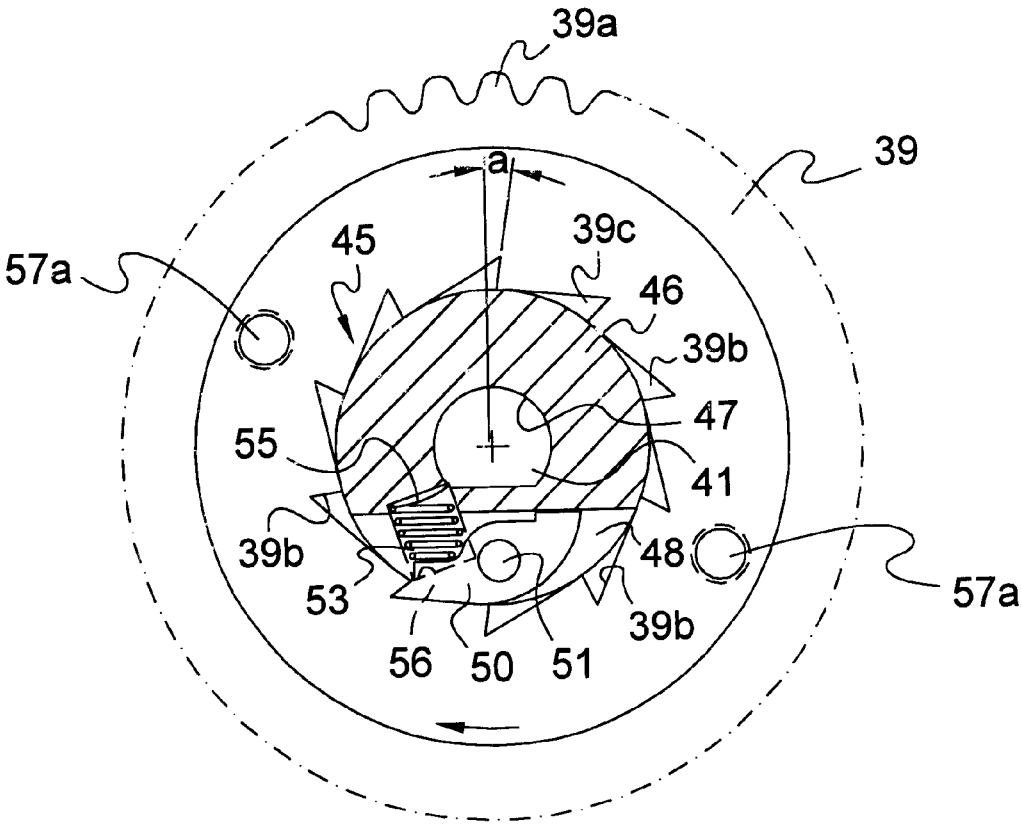
FIG. 5 is an enlarged, side view of the drive gear for the take-up roller of the web cleaning assembly of FIG. 3 and the clutch mechanism of the present invention.

Drive gear 39 has an outer set of teeth 39*a* which is adapted to mesh with the teeth on gear 38 on take-up roller 34 whereby when drive gear 39 is rotated in a clockwise direction (FIG. 4), take-up roller 34 will be rotated in a counterclockwise direction. Also, drive gear 39 has an inner set of teeth 39*b*, which are formed around the circumference of a central bore 39*c*, which in turn, passes through the center of drive gear 39. Preferably, the number of inner teeth 39*b* is small in comparison with the outer number of tooth 39*a* so as to provide a good mechanical advantage between the two. For example, the set of inner teeth 39*b* can be comprised of 10 teeth set at a radial angle of about 36° from each other. Preferably, the leading edge of each tooth 39*b* is inclined forward with respect to the radius of drive gear 39 at a drive angle "a" (e.g. about 10°, see FIG. 5) for a purpose to be described below. A diametrically-extending handle 55*a* extends across the outside of drive gear 39 and is connected thereto by any appropriate means, e.g. bolts 57 (FIG. 4) which are threaded into holes 57*a* on gear 39 (FIG. 5).

Drive gear 39 is assembled onto hub 46, which in turn, is drivingly connected to the drive shaft 41 of drive motor 40. When clutch mechanism 45 is fully assembled, the outer or forward end 51 of pawl 50 will be biased outwardly and will extend outward from slot 48 and into contact with the inclined, leading edge of a respective inner teeth 39*b* to thereby form a positive, driving connection therebetween whenever hub 46 is rotated in a clockwise direction (as viewed in FIG. 4) by motor 40; this being the case during normal operation of the copying machine 10.

When the supply roller 32 and take-up roller 34 need to be changed, web cleaning assembly 30 is slid out of the fuser housing and the rollers are replaced. As mentioned above, there will normally be a certain amount of slack 3 is in web 31 after the new rollers have been installed which, if not removed, can lead to serious problems. To remove this slack, drive gear 39 is manually rotated by gripping and turning handle 55*a* in a clockwise direction (FIG. 4). As gear 39 rotates in a forward direction (i.e. clockwise), hub 46 on motor 40 remains stationary causing pawl 50 in the hub to ride up along the ramp of a respective inner tooth 39*b* against the bias of spring 53.

This allows gear 39 to override the stationary hub 46 in the clockwise direction and rotate relative thereto. Since drive gear 39 remains meshed with gear 38 on take-up roller 34, the manual rotation of drive gear 39 will also rotate gear 38 in a counterclockwise direction (FIG. 4) to thereby take up the slack 31*s* in web 31. Once the unwanted slack is removed from web 31, the web cleaning assembly 30 is repositioned within fuser housing 25 and the machine 10 is now ready for operation. Upon the start of operation, drive motor 40 will again rotate drive gear 39 in a clockwise direction since spring 53 will bias the outer edge 51 of pawl 50 into driving engagement with the leading edge of a respective inner tooth 39*b*.

It should be evident from the above that any slack, present in the web 31 after the web supply and take-up rollers have been installed, can quickly be removed by manually rotating the drive gear 39 without having to rotate the drive motor, itself. This allows the supply and take-up rollers to be replaced, easily and quickly, by a single, minimally trained serviceperson without the need for any special tools or assistance. This is very important in reducing the costs and the down time normally associated with machines of this type.

What is claimed is:

1. An electrophotographic apparatus having a fuser section, said fuser section comprising:

a housing;

a fuser roller mounted in said housing;

at least one heater roller mounted in said housing and in contact with said fuser roller for transferring heat thereto; and a web cleaning assembly in said housing for cleaning contaminants off of said at least one heater roller, said web cleaning assembly comprising:

a frame;

a supply roller rotatably mounted in said frame, said supply roller adapted to have a web of cleaning material wound thereon;

a take-up roller rotatably mounted in said frame; said take-up roller adapted to receive said web of said cleaning material from said supply roller after said web contacts said at least one heater roller;

a take-up gear having an outer set of teeth on the outer circumference thereof, said take-up gear being drivingly connected to said take-up roller for rotating said take-up roller;

a motor for driving said take-up gear; and a clutch mechanism for allowing said take-up gear to be rotated without rotating said motor to thereby take-up any slack in said web cleaning material.

2. The electrophotographic apparatus of claim 1 including:

a drive gear drivingly connected to said motor, said drive gear having an outer set of teeth on the outer circumference thereof which mesh with said outer set of teeth on said take-up gear whereby said take-up roller is rotated when said drive gear is rotated.

3. The electrophotographic apparatus of claim 2 wherein said motor has a drive shaft and wherein said drive gear has a central bore therethrough, said clutch mechanism comprises:

a set of inner teeth formed around said central bore of said drive gear;

a hub mounted on said drive shaft for rotation therewith and positioned within said central bore of drive gear;

a pawl pivotably mounted on said hub and biased outwardly into engagement with one of said set of inner teeth on said drive gear to thereby form a driving connection between said hub and said drive gear when said hub is rotated in a first direction but which allows relative movement between said hub and said drive gear when said drive near is rotated while said hub is stationary.

4. The electrophotographic apparatus of claim 3 wherein said pawl is biased outwardly by a spring positioned between said pawl and said hub.

5. The electrophotographic apparatus of claim 4 wherein said inner set of teeth comprises:

ten teeth spaced around said circumference of said central bore at a radial angle of about 36° from each other.

6. The electrophotographic apparatus of claim 3 including:

a handle connected to said drive gear for manually rotating said drive gear.

7. A web cleaning assembly adapted to be mounted in a fuser section of a electrophotographic apparatus for cleaning contaminants off of at least one heater roller in said fuser section, said web cleaning assembly comprising:

a frame adapted to be mounted in said fuser section;

a supply roller rotatably mounted in said frame, said supply roller adapted to have a web of cleaning material wound thereon;

a take-up roller rotatably mounted in said frame; said take-up roller adapted to receive said web of said cleaning material from said supply roller after said web contacts said at least one heater roller;

a take-up gear having an outer set of teeth on the outer circumference thereof, said take-up gear being drivingly connected to said take-up roller for rotating said take-up roller;

a motor for driving said take-up gear; and a clutch mechanism for allowing said take-up gear to be manually rotated without rotating said motor to thereby take-up any slack in said web cleaning material.

8. The web cleaning assembly of claim 7 including:

a drive gear drivingly connected to said motor, said drive gear having an outer set of teeth on the outer circumference thereof which mesh with said outer set of teeth on said take-up gear whereby said take-up roller is rotated whenever said drive gear is rotated.

9. The web cleaning assembly of claim 8 wherein said motor has a drive shaft and wherein said drive gear has a central bore therethrough and wherein said clutch mechanism comprises:

a set of inner teeth formed around said central bore of said drive gear;

a hub mounted on said drive shaft for rotation therewith and positioned within said central bore of drive gear, said hub having a slot therein which is open along a portion of the circumference of said hub;

a pawl pivotably mounted within said slot in said hub and biased cyst outwardly into engagement with one of said set of inner teeth on said drive gear to thereby form a driving connection between said hub and said drive gear when said hub is rotated in a first direction but which allows relative movement between said hub and said drive gear when said drive gear is rotated in said first direction while said hub is stationary.

10. The web cleaning assembly of claim 8 wherein said motor has a drive shaft and wherein said drive gear has a central bore therethrough and wherein said clutch mechanism comprises:

a set of inner teeth formed around said central bore of said drive gear;

a hub mounted on said drive shaft for rotation therewith and positioned within said central bore of drive gear;

a pawl pivotably mounted on said hub and biased outwardly into engagement with one of said set of inner teeth on said drive gear to thereby form a driving connection between said hub and said drive gear when said hub is rotated in a first direction but which allows relative movement between said hub and said drive gear when said drive gear is rotated in said first direction while said hub is stationary.

11. The web cleaning assembly of claim 10 wherein said pawl is biased outwardly by a spring positioned between said pawl and said hub.

12. The web cleaning assembly of claim 11 wherein said inner set of teeth comprises:

ten teeth spaced around said circumference of said central bore at a radial angle of about 36° from each other.

13. The web cleaning assembly of claim 12 including:

a handle connected to said drive gear for manually rotating said drive gear.

14. The web cleaning assembly of claim 11 wherein the leading edge of each tooth of said inner set of teeth is inclined forward with respect to the radius of said drive gear at an drive angle $\alpha$.

15. The web cleaning assembly of claim 14 wherein said drive angle a is about 10°.

* * * * *